US005195480A

United States Patent [19]

Hudson

[11] Patent Number: 5,195,480

[45] Date of Patent: Mar. 23, 1993

[54] METHOD OF MANUFACTURING ENGINES

[75] Inventor: Eric B. Hudson, Hilbert, Wis.

[73] Assignee: Tecumseh Products Company, Tecumseh, Mich.

[21] Appl. No.: 688,052

[22] Filed: Apr. 19, 1991

[51] Int. Cl.[5] ..... F02B 77/00

[52] U.S. Cl. ..... 123/195 R; 29/463; 29/888.01

[58] Field of Search ..... 123/195 R, 195 C; 29/30, 416, 445, 463, 888.01; 409/138, 251

[56] References Cited

U.S. PATENT DOCUMENTS

| | | | |
|---|---|---|---|
| 1,685,224 | 9/1928 | Blomstrom | 409/276 |
| 1,749,761 | 3/1930 | Eggenweiler | 409/761 |
| 1,937,887 | 12/1933 | Halborg | 409/276 |
| 4,132,494 | 1/1979 | Aldridge, Jr. | 408/54 |
| 4,212,573 | 7/1980 | Fields | 409/251 |
| 4,369,744 | 1/1983 | Kubozuka et al. | 123/195 C |
| 4,674,455 | 6/1987 | Tsuboi | 123/195 R |
| 4,690,112 | 9/1987 | Arnold | 123/195 R |
| 4,754,540 | 7/1988 | Suica et al. | 29/416 |
| 4,799,836 | 1/1989 | Kurisu et al. | 409/138 |
| 4,838,221 | 6/1989 | Suemori | 123/195 H |
| 5,007,307 | 4/1991 | Tamazawa et al. | 123/195 C |

*Primary Examiner*—Noah P. Kamen
*Attorney, Agent, or Firm*—Baker & Daniels

[57] ABSTRACT

A method of broaching the surfaces of crankcase halves to permit upper and lower halves to be subsequently assembled in random pairs as a crankcase for use in an internal combustion engine. Each of the halves is broached along an essentially flat mating portion and main bearing half bores. The broached halves are then assembled together along their respective mating surfaces.

21 Claims, 4 Drawing Sheets

METHOD OF MANUFACTURING ENGINES

BACKGROUND OF THE INVENTION

The present invention relates generally to the assembly of crankcases in the manufacture of internal combustion engines and, more particularly, to the finishing of crankcase halves on their mating surfaces and main bearing half bores.

Presently, in the manufacture of many small engines, crankcases are assembled by finishing the crankcase halves on their mating surfaces and bolting the halves together so that the main bearing bores may then be machined. Once the bearing bores are machined, the halves fit together as a matched set and must remain together throughout the manufacturing process. In other words, the crankcase half of one set will not fit together with the crankcase half of another set. After the main bearing bores are machined, the matched halves are disassembled and cleaned, and the internal components of the engine are installed. Once the engine components are installed, the mating halves are reassembled at final assembly.

In manufacturing engines, the various engine components are often machined in areas some distance from the final assembly point, requiring, in some instances, that the crankcase be transported to the various facilities. A problem arises in that it is possible for crankcase halves to become damaged, separated or lost from their mates in handling or transit, thus rendering both crankcase halves unusable.

It is desired to provide a more efficient method of manufacturing engines.

SUMMARY OF THE INVENTION

The present invention generally provides a method for preparing crankcase halves, wherein the halves are broached in a manner to allow any two upper and lower halves to be subsequently assembled in random pairs for use in an internal combustion engine.

More specifically, the present invention provides a method of manufacturing an internal combustion engine wherein each of the crankcase halves is broached along an essentially flat mating portion and main bearing half bore portion. The halves are then fixed together along their respective mating surfaces, wherein the respective main bearing half bores define an opening for the main bearing of the crankshaft.

An advantage of the method of the present invention is that the main bearing bore may be machined without requiring assembly and disassembly of the crankcase halves.

Another advantage of the method of the present invention is that the crankcase halves may be matched with any other half so that the halves may be transported to various locations without requiring pairs of crankcase halves to remain together while in transit.

Yet another advantage of the method of the present invention is that the main bearing bores of the crankshaft may be machined without a separate boring operation.

The present invention, in one form thereof, provides a method of preparing crankcase halves, wherein the halves may be subsequently assembled in random pairs for use in internal combustion engines. A plurality of cast crankcase halves are provided, each including a mating surface for mating with another half. Each of the halves includes a mating surface and a round recessed portion defining a main bearing half bore. The mating surface and main bearing half bore of each of the crankcase halves is broached in a manner to allow any upper and lower crankcase half to be mated along their respective mating surfaces to form a crankcase so that the main bearing half bores define an opening for the main bearing of a crankshaft.

The present invention, in one form thereof, provides a method of manufacturing an internal combustion engine in which two crankcase halves are provided, each of the halves including a mating surface for mating with the other half. Each half also includes a round recessed portion defining a main bearing half bore. The mating surface and main bearing half bore of each of the halves are machined by broaching or some other technique, and the halves are then fixed together to form a crankcase. The halves are mated along their respective mating surfaces so that the main bearing half bores define an opening for the main bearing of the crankshaft.

The present invention, in one form thereof, provides an internal combustion engine that is prepared by the process described above.

DESCRIPTION OF THE PREFERRED EMBODIMENT

Figure 1:
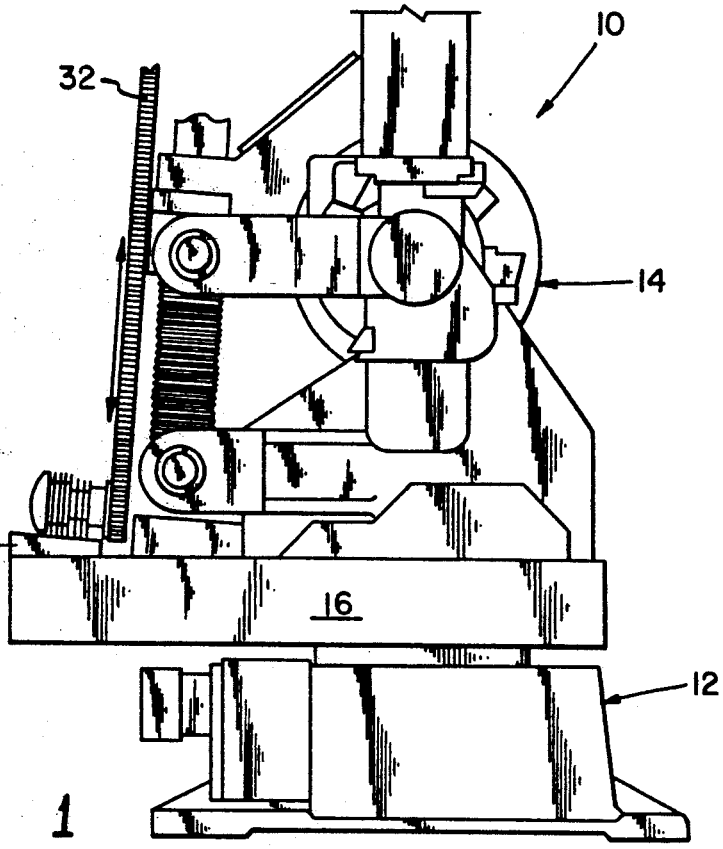
FIG. 1 is a side elevational view of a broaching machine according to the present invention.

Referring in particular to FIG. 1, there is shown a broaching machine 10 having a base 12 and a main body 14 including a table 16 and a broaching cutter 32. An example of a preferred broaching machine is the "Ohio" vertical surface broach machine manufactured by The Ohio Broach and Machine Company located in Willoughby, Ohio.

In order to broach the bearing bores and mating surfaces of the top and bottom halves of an engine crankcase, fixture 34 is mounted on table 16. The fixture is manually loaded and unloaded and includes clamps and support jacks that may operate automatically with the machine cycle. The cutter path of broach 32 is shown by the arrows in FIG. 1. Both halves of the crankcase are broached by the same or similar broach 32 to be described herein.

Figure 2:
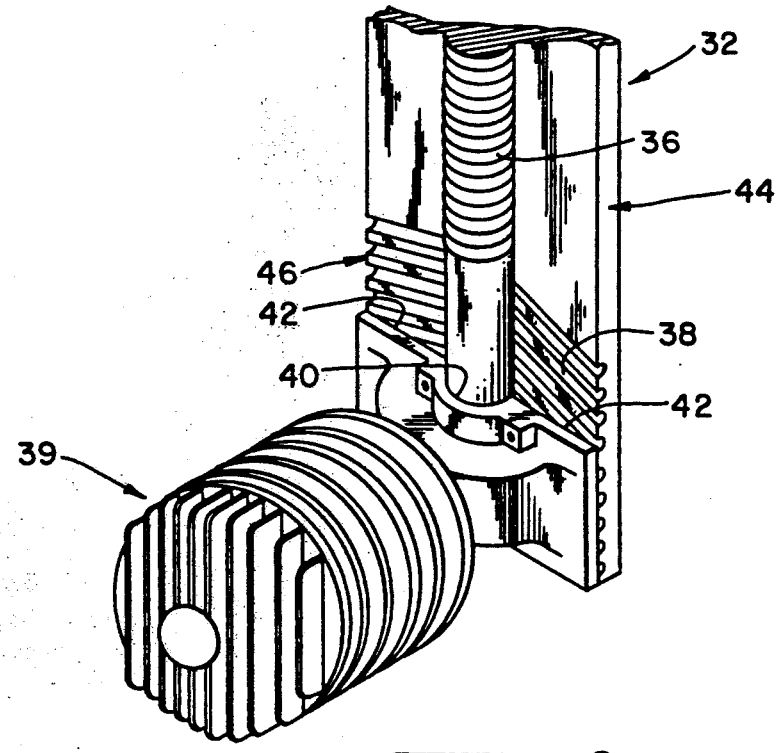
FIG. 2 is an enlarged, isolated, front perspective view of the broaching tool of FIG. 1 and including an upper crankcase half mounted thereto.
Figure 6:
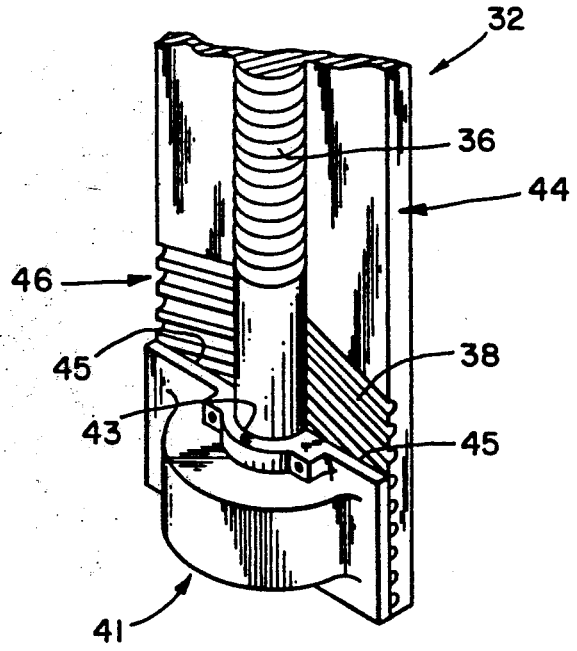
FIG. 6 is a view of the broaching tool of FIG. 2 and including a lower crankcase half mounted thereto.

Referring to FIGS. 2 and 6, broach 32 includes round 36 and flat 38 broach inserts. In FIG. 2, there is shown a cylinder half or upper crankcase half 39 of a typical single cylinder internal combustion engine. Upper crankcase half 39 is shown being machined by broach 32, and in FIG. 6, a typical lower crankcase half 41 is shown in position to be machined by broach 32. Upper half 39 includes main bearing half bores 40 and a pair of flat surfaces 42 which mate with similar surfaces on the lower crankcase half. It is understood that references to the broaching of bearing half bores 40 and flat surfaces 42 of upper half 39 also pertain to main bearing half bores 43 and flat surfaces 45 of lower half 41, respectively.

Referring to FIG. 2, round tool 36 is utilized for broaching the bearing half bores 40 of a half 39, and flat broach inserts 38 are utilized for broaching flat mating surfaces 42 of half 39. As shown, upper portion 44 of broach 32 includes only round tool 36, and lower portion 46 of broach 32 includes only flat broach inserts 38 so that the mating surface of crankcase 39 is sequentially broached. In other words, as broach 32 is moved along the mating surfaces of crankcase 39, flat mating surfaces 42 are first broached by flat broach inserts 38 (FIG. 4), and then bearing half bores 40 are broached by round tool 36 (FIG. 5).

Figure 3:
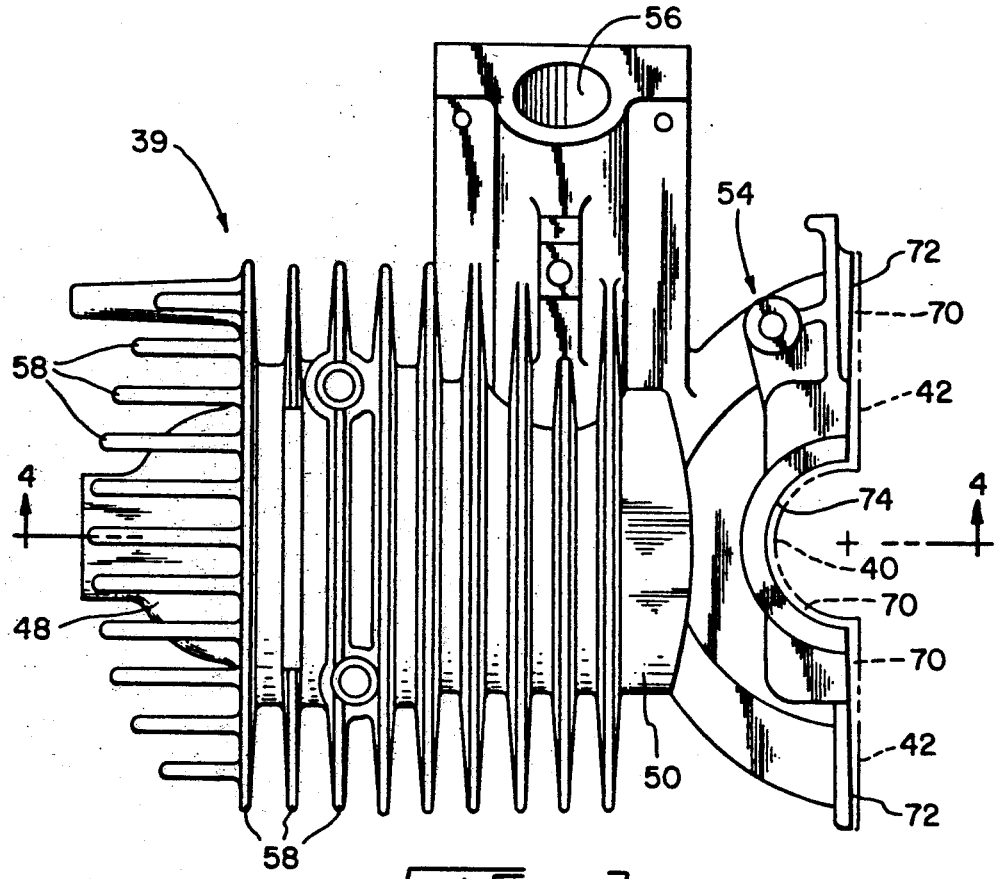
FIG. 3 is a vertical elevational view of the upper half of a crankcase, particularly showing the material removed in broaching.
Figure 4:
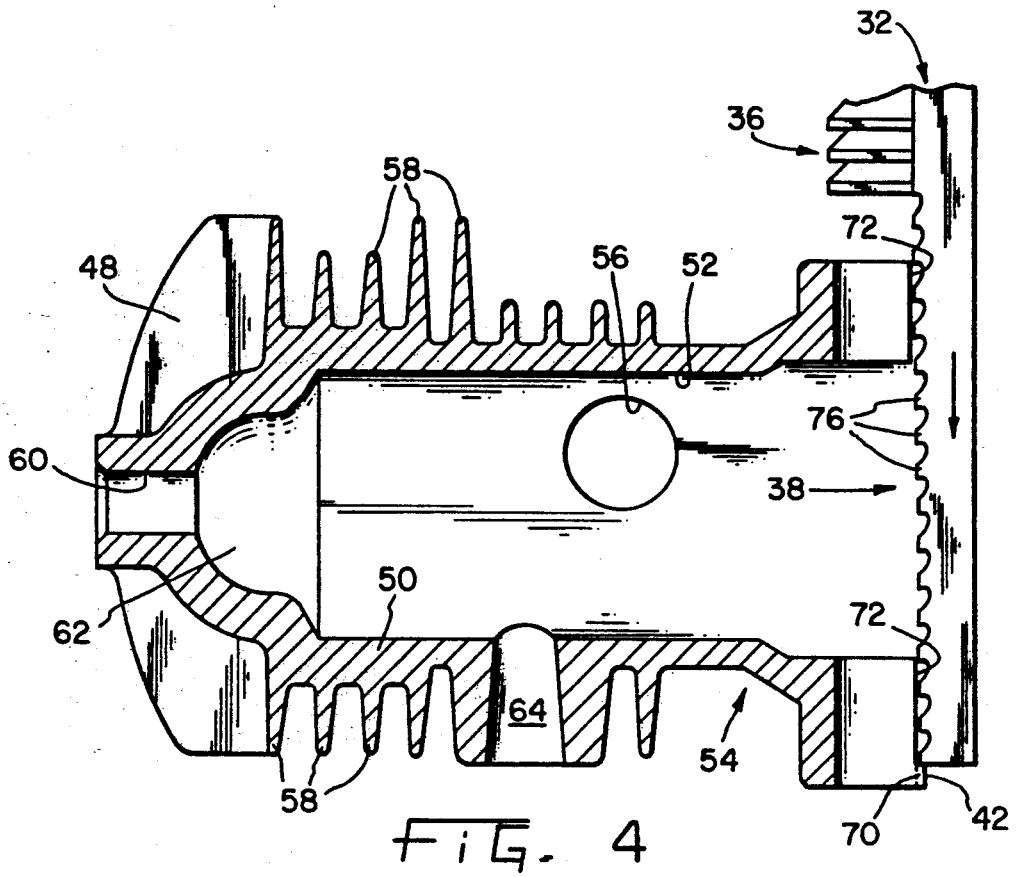
FIG. 4 is an isolated sectional view of the upper crankcase of FIG. 3, taken along line 4—4 of FIG. 3, and particularly showing the broaching of the flat mating surfaces.

Referring to FIG. 3, upper crankcase half 39 includes an integrally cast cylinder head portion 48, a body portion 50 defining a cylinder bore 52 (FIGS. 4–5), and an integrally cast crankshaft housing 54. An intake passage 56 is integrally cast to body portion 50. Vertically oriented circumscribing cooling fins 58 are cast integrally with cylinder head portion 48 and body portion 50. As shown in FIGS. 4 and 5, a spark plug opening 60 communicates with firing chamber 62. An exhaust port 64 is provided in the cylinder port for the removal of combustion gases.

Referring again to FIG. 3, there is shown in dotted lines the original as cast flat mating surfaces 42 and bearing half bores 40 of crankshaft housing 54 before broaching. Upon broaching these surfaces, material 70 is removed resulting in broached flat mating surfaces 72 and broached bearing half bores 74.

Figure 5:
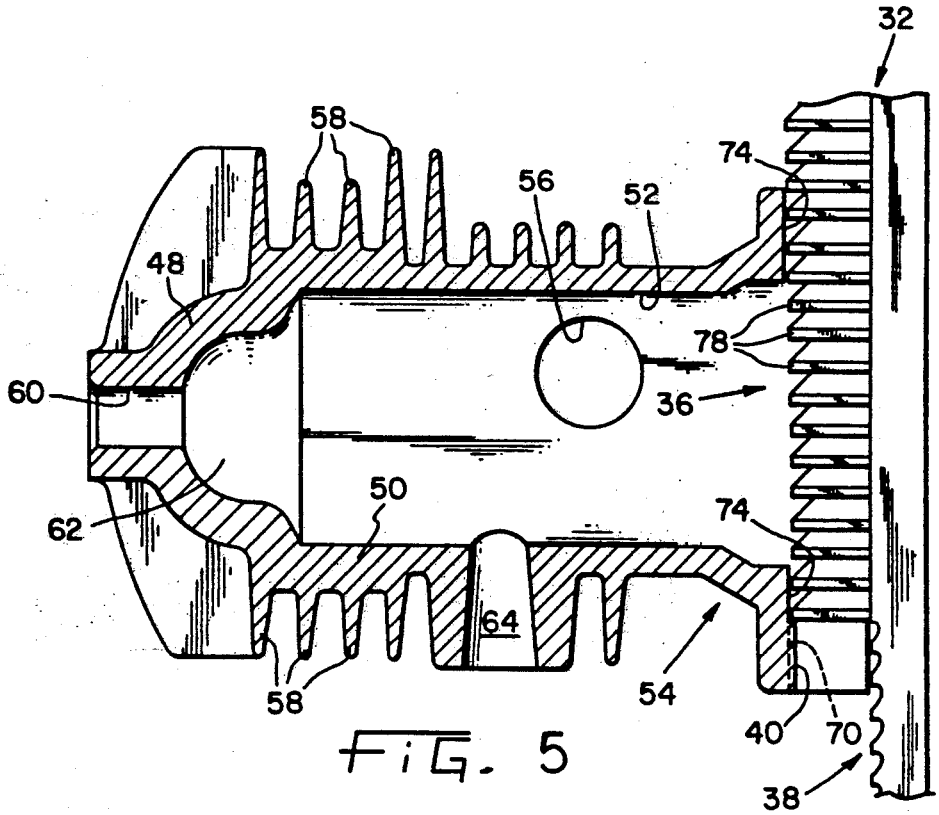
FIG. 5 is a view of the crankcase of FIG. 4, and particularly showing the broaching of the main bearing half bore.
Figure 7:
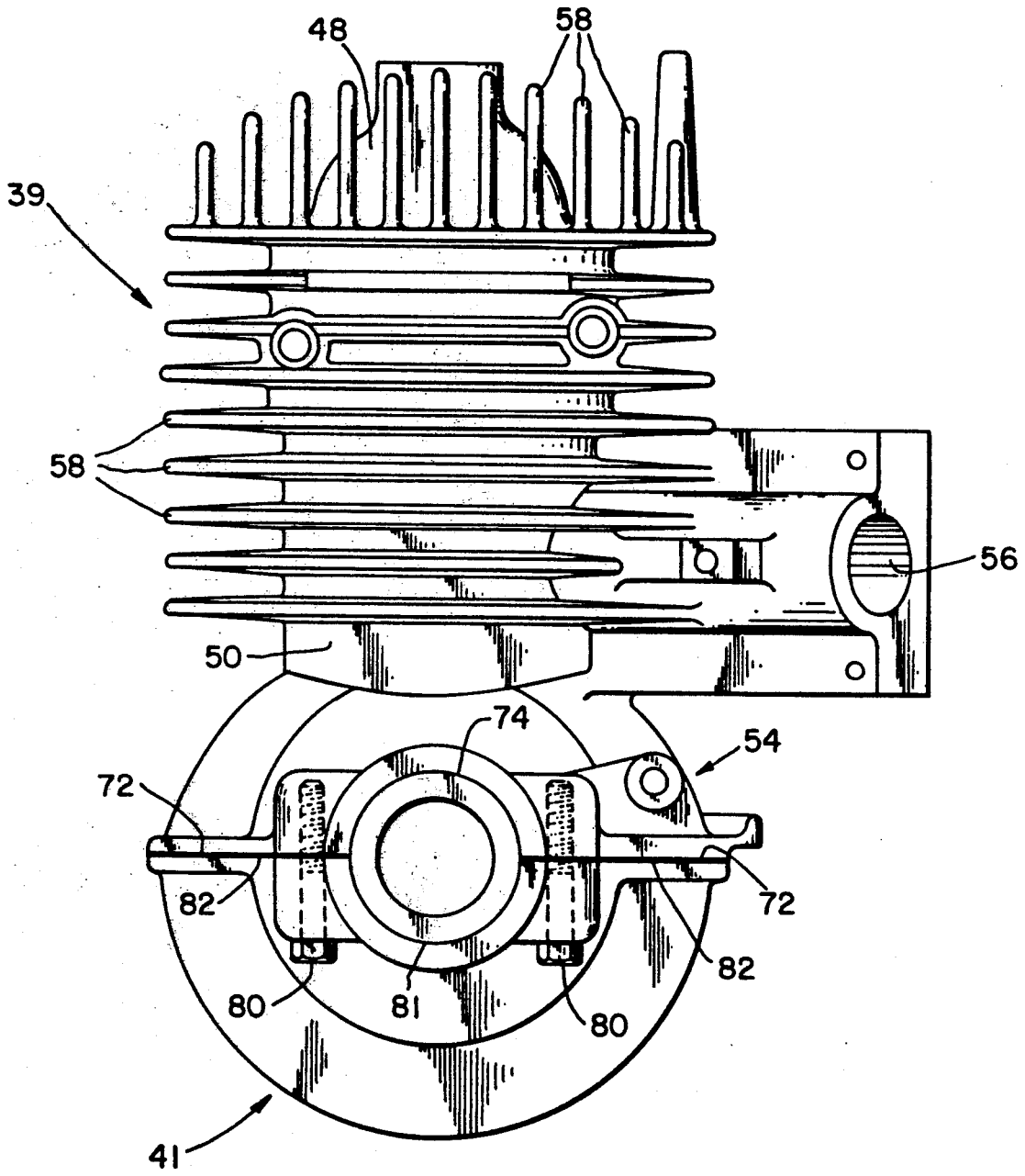
FIG. 7 is a vertical sectional view of an assembled crankcase in accordance with the present invention.

Referring now to FIGS. 4 and 5, there is shown the sequence for broaching the mating surfaces of the crankcase halves so that any upper crankcase half may be assembled with any lower crankcase half, thereby permitting the assembly of crankcases from randomly selected upper and lower halves. In the broaching process, broach 32 moves downwardly across the stationary crankcase half. In FIG. 4, broach 32 is moved in the direction of the arrow so that teeth 76 of flat broach inserts 38 remove material 70 from original flat mating surfaces 42 to form broached mating surfaces 72. As broach 32 continues downwardly, FIG. 5 illustrates that teeth 78 of round tool 36 broach original bearing half bores 40, thereby removing material 70 to form broached bearing half bores 74. It is noted that the entire broaching process occurs in one pass of broach 32 along the mating surfaces 42 of the crankcase half. In addition to mating surfaces 42 of upper crankcase 39, main bearing half bores 43 and flat mating surfaces 45 of lower crankcase half 41 are similarly broached by broach 32 to form broached half bores 81 and broached mating surfaces 82, as shown in FIG. 7. Although the broaching process has been described as first broaching the flat mating surfaces and then the bearing half bores, it is understood that the flat mating surfaces and the bearing half bores may be alternately or simultaneously broached.

Once the crankcase halves have been broached as described above, the accuracy obtainable in the broaching process permits the halves to be intermixed with one another for shipping and storage purposes without the need to keep matched pairs of halves together. When it is desired to assemble a crankcase from a randomly selected broached upper half and broached lower half, the halves are aligned by bearing cages (not shown) along the main bearing axis and secured together by bolts 80 (FIG. 7). Flat mating surfaces 72 are slanted as shown in FIG. 3 so that bolts 80 draw mating surfaces 72 and 82 of the respective top and bottom halves together during assembly. Since the crankcase halves need only be brought together at final assembly, the broaching process significantly increases the efficiency at which engines may be manufactured.

Although broaching is the preferred method of machining the crankcase halves, other machining techniques which have cutters traveling in the direction of the main bearing bore axis could be utilized.

It will be appreciated that the foregoing is presented by way of illustration only, and not by way of any limitation, and that various alternatives and modifications may be made to the illustrated embodiment without departing from the spirit and scope of the invention.

What is claimed is:

1. A method of preparing crankcase halves, wherein the halves may be subsequently assembled in random pairs for use in internal combustion engines, comprising the steps of:

providing a pair of crankcase halves, each one of said halves including a mating surface for mating with the other one of said halves and a round recessed portion defining a main bearing half bore; and broaching said mating surface and said main bearing half bore of each one of said halves, said broaching being performed in a manner allowing any two of said plurality of crankcase halves to be mated to form a crankcase, wherein said main bearing half bores define an opening for a main bearing of a crankshaft.

2. The method of preparing crankcase halves according to claim 1, wherein the step of broaching includes first broaching said mating surface and then broaching said main bearing half bore.

3. The method of preparing crankcase halves according to claim 1, wherein the step of broaching includes first broaching said main bearing half bore and then broaching said mating surface.

4. The method of preparing crankcase halves according to claim 1, wherein the step of broaching includes simultaneously broaching said mating surface and said main bearing half bore.

5. The method of preparing crankcase halves according to claim 1, wherein the step of broaching said mating surface and said main bearing half bore occurs in one broaching pass along said crankcase half.

6. The method of preparing crankcase halves according to claim 1, wherein the step of broaching said mating surface is performed such that said mating surface includes a pair of slanted half surfaces, said half surfaces being broached symmetrically with respect to said main bearing half bore and being slanted away from said crankcase half in a radial direction away from said main bearing half bore.

7. A method of assembling an internal combustion engine including a crankshaft and a main bearing for the crankshaft, comprising the steps of:

providing two crankcase halves, each one of said halves including a mating surface for mating with another one of said halves and a round recessed portion defining a main bearing half bore;

broaching said mating surface and main bearing half bore of each one of said halves; and fixing together said crankcase halves to form a crankcase, said halves being mated along their respective mating surfaces, and wherein said main bearing half bores define an opening for said main bearing of said crankshaft.

8. The method of assembling the internal combustion engine according to claim 7, wherein the step of broaching includes first broaching said mating surface and then broaching said main bearing half bore.

9. The method of assembling the internal combustion engine according to claim 7, wherein the step of broaching includes first broaching said main bearing half bore and then broaching said mating surface.

10. The method of assembling the internal combustion engine according to claim 7, wherein the step of broaching said mating surface and said main bearing half bore occurs in one broaching pass along said crankcase half.

11. The method of assembling the internal combustion engine according to claim 7, wherein said main bearing half bores define first and second openings for first and second main bearings of the crankshaft.

12. The method of assembling the internal combustion engine according to claim 7, wherein the step of broaching said mating surface is performed such that said mating surface includes a pair of slanted half surfaces, said half surfaces being broached symmetrically with respect to said main bearing half bore and being slanted away from said crankcase half in a radial direction away from said main bearing half bore.

13. An internal combustion engine including a crankshaft, a main bearing for the crankshaft, and a pair of crankcase halves prepared by the process comprising the steps of:

providing two crankcase halves, each one of said halves including two mating surfaces for mating with the other one of said halves and a round recessed portion defining two main bearing half bores;

broaching said mating surfaces and said main bearing half bores of each one of said halves, said broaching being performed in a manner allowing said crankcase halves to be mated along respective said mating surfaces to form a crankcase, wherein said main bearing half bores define an opening for a main bearing of the crankshaft; and assembling said halves around the crankshaft.

14. The internal combustion engine according to claim 13, including the step of fixing together said crankcase halves to form said crankcase after broaching said mating surfaces.

15. The internal combustion engine according to claim 13, wherein the step of broaching includes first broaching said main bearing half bores and then broaching said mating surfaces.

16. The internal combustion engine according to claim 13, wherein the step of broaching includes first broaching said mating surfaces and then broaching said main bearing half bores.

17. The internal combustion engine according to claim 13, wherein the step of broaching said mating surfaces and said main bearing half bores occurs in one broaching pass along said crankcase half.

18. The internal combustion engine according to claim 13, wherein said main bearing half bores define first and second openings for first and second main bearings of the crankshaft.

19. The internal combustion engine according to claim 13, wherein the step of broaching said mating surfaces is performed such that each said mating surface is broached symmetrically with respect to said main bearing half bores and is slanted away from said crankcase half in a radial direction away from said main bearing half bores.

20. A method of preparing crankcase halves, wherein the halves may be subsequently assembled in random pairs for use in internal combustion engines, comprising the steps of:

providing a plurality of crankcase halves, each one of said halves including a mating surface for mating with another one of said halves and a round recessed portion defining a main bearing half bore; and machining said mating surface and main bearing half bore of each one of said halves in one pass, said machining being performed in a manner allowing any two of said plurality of crankcase halves to be mated along said respective mating surfaces to form a crankcase, wherein said main bearing half bores define an opening for a main bearing of a crankshaft.

21. A method of preparing crankcase halves, wherein the halves may be subsequently assembled in random pairs for use in internal combustion engines, comprising the steps of:

providing a plurality of crankcase halves, each one of said halves including a mating surface for mating with another one of said halves and a round recessed portion defining a main bearing half bore; and simultaneously machining said mating surface and main bearing half bore of each one of said halves, said machining being performed in a manner allowing any two of said plurality of crankcase halves to be mated along said respective mating surfaces to form a crankcase, wherein said main bearing half bores define an opening for a main bearing of a crankshaft.

* * * * *